US009021773B2

(12) United States Patent
Ford

(10) Patent No.: US 9,021,773 B2
(45) Date of Patent: May 5, 2015

(54) LARGE CONTAINER LOADING SYSTEM FOR A PACKAGING MACHINE

(75) Inventor: Colin P. Ford, Woodstock, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 1139 days.

(21) Appl. No.: 13/005,773

(22) Filed: Jan. 13, 2011

(65) Prior Publication Data

US 2011/0173931 A1 Jul. 21, 2011

Related U.S. Application Data

(60) Provisional application No. 61/295,346, filed on Jan. 15, 2010, provisional application No. 61/387,161, filed on Sep. 28, 2010.

(51) Int. Cl.

| | |
|---|---|
| ***B65B 5/04*** | (2006.01) |
| ***B65B 35/56*** | (2006.01) |
| ***B65B 35/58*** | (2006.01) |
| ***B65B 35/20*** | (2006.01) |
| ***B65B 21/24*** | (2006.01) |

(52) U.S. Cl.

CPC ..... *B65B 35/205* (2013.01); *B65B 5/04* (2013.01); *B65B 21/242* (2013.01); *B65B 35/56* (2013.01)

(58) Field of Classification Search

CPC ..... B65B 5/04; B65B 21/04; B65B 21/242; B65B 35/205; B65B 35/56; B65B 35/58; B65G 47/244

USPC ..... 53/544, 566, 249–252, 258; 198/377.02

See application file for complete search history.

(56) References Cited

U.S. PATENT DOCUMENTS

| | | | | | |
|---|---|---|---|---|---|
| 2,263,501 | A | * | 11/1941 | Jones | 53/566 |
| 2,642,212 | A | * | 6/1953 | Currivan | 53/252 |
| 2,662,355 | A | * | 12/1953 | Ross | 53/566 |
| 2,864,216 | A | * | 12/1958 | Long et al. | 53/252 |
| 3,043,070 | A | * | 7/1962 | Cammack | 53/544 |
| 3,139,714 | A | * | 7/1964 | Hall | 53/252 |
| 3,933,236 | A | * | 1/1976 | Aterianus et al. | 198/377.02 |
| 4,716,714 | A | * | 1/1988 | Tisma | 53/251 |

(Continued)

FOREIGN PATENT DOCUMENTS

| | | | | | |
|---|---|---|---|---|---|
| DE | 3524547 | A1 | * | 1/1987 | 53/251 |
| EP | 0018599 | A1 | * | 11/1980 | B65B 21/04 |

(Continued)

OTHER PUBLICATIONS

European Search Report for EP 11 00 0229 dated Sep. 6, 2013, 7 pages.

*Primary Examiner* — Stephen F Gerrity

(74) *Attorney, Agent, or Firm* — Womble Carlyle Sandridge & Rice, LLP

(57) ABSTRACT

A large container loading system and method for a packaging machine includes an infeed conveyor and a transfer flight. An array of pivotable cradle lugs is carried by the transfer flight in synchronized movement with cartons on an adjacent carton flight. Containers are moved into the cradle lugs in an upright orientation and the cradle lugs and containers are reoriented to a substantially horizontal or sideways orientation before being pushed into their cartons by an inserter assembly. A transfer block or a support conveyor may be positioned between each of the cradle lugs and an aligned open container to support a container as it moves between a cradle lug and a carton.

29 Claims, 11 Drawing Sheets

(56) References Cited

U.S. PATENT DOCUMENTS

| | | | | | |
|---|---|---|---|---|---|
| 5,157,894 | A * | 10/1992 | Mini et al. | 53/148 |
| 5,484,052 | A * | 1/1996 | Pawloski et al. | 198/867.05 |
| 5,706,633 | A | 1/1998 | Moncrief et al. | |
| 6,293,387 | B1 * | 9/2001 | Forster | 198/377.02 |
| 7,025,192 | B2 * | 4/2006 | Hoeg et al. | 198/377.02 |
| 7,191,892 | B2 * | 3/2007 | Monti | 198/377.02 |

FOREIGN PATENT DOCUMENTS

| | | | | | |
|---|---|---|---|---|---|
| EP | 1 612 147 | A1 | | 1/2006 | |
| GB | 902606 | A | * | 8/1962 | B65B 35/205 |
| JP | 62136413 | A | * | 6/1987 | 198/377.02 |
| JP | S64-26206 | U | | 2/1989 | |
| JP | 05221404 | A | * | 8/1993 | 53/252 |

* cited by examiner

LARGE CONTAINER LOADING SYSTEM FOR A PACKAGING MACHINE

REFERENCE TO RELATED APPLICATIONS

Priority is hereby claimed to the filing dates of U.S. provisional patent application No. 61/295,346 filed on Jan. 15, 2010 and provisional patent application No. 61/387,161 filed on Sep. 28, 2010.

TECHNICAL FIELD

This disclosure relates generally to packaging systems and methods and more specifically to systems and methods for loading large beverage containers into paperboard cartons.

BACKGROUND

High speed commercial packaging machines for loading items such as grouped beverage cans and containers into paperboard cartons are well known. Examples are shown in a variety of patents such as, for instance, U.S. Pat. No. 5,706,633, owned by the assignee of the present invention, the entire contents of which are hereby incorporated by reference.

There is a commercial demand for larger heavier containers to be packaged into cartons for transport and sale. Such containers may include, for example, bulk soft drink containers such as two liter containers and larger filled with soft drink and small mini-kegs of beer that have more recently become popular. Loading such containers into cartons in a high speed commercial packaging machine presents numerous unique challenges that arise from the large size, substantial weight when filled, and relatively fragile walls of larger containers. For example, because large containers filled with product are significantly heavier than smaller containers such as beverage cans, they can develop significantly more momentum when moving through a packaging machine at high speeds. It is thus more difficult to stop them or change their direction without puncturing or otherwise damaging the walls of the container. This can be particularly troublesome in the event of an emergency stop of the packaging machine, wherein the containers come to an abrupt stop. This can cause large containers to tip over due to their momentum, which can cascade and result ultimately in broken containers, spilled product, and can require much clean-up and reset time to be dedicated by machine operators.

Because of the nature of high speed packaging machines and the cartons into which articles are packaged, large containers such as those discussed above are most efficiently moved into their cartons on their sides. More specifically, the containers are most efficiently loaded by being pushed into the open tops or bottoms of corresponding cartons, which also are oriented on their sides and moved synchronously with the containers. However, the containers are naturally conveyed, perhaps filled, and arranged at upstream stations of the packaging machine in an upright orientation. Accordingly, they must be reoriented by being laid over on their sides before entering the insertion station of the packaging machine, which pushes the containers into their cartons. Such reorientation is generally not required for smaller articles such as beverage cans. The challenge is to reorient the large heavier containers, which are moving at relatively high speeds, from their upright orientations to a sideways orientation and to space them to match the pitch of the adjacent cartons in a gentle and controlled manner so that they do not become displaced or damaged during the process.

A need exists for a method and apparatus to handle and reorient larger heavier containers such as mini-kegs and large soft drink bottles in a high speed packaging machine in such a way that the containers do not become damaged or displaced. A related need exists for a method and apparatus for containing or stabilizing such containers as they are conveyed and reoriented to prevent tipping of the containers. It is to the provision of a method and apparatus that address these and other challenges that the invention disclosed herein is primarily directed.

SUMMARY

The disclosures of U.S. provisional application No. 61/295,346 filed on Jan. 15, 2010 and provisional patent application No. 61/387,161 filed on Sep. 28, 2010, are hereby incorporated by reference as if fully set forth herein.

Briefly described, a packaging machine is disclosed for packaging large heavy containers such as mini-kegs of beer into cartons, which may be made of paperboard. The packaging machine includes, among other things, an infeed conveyor along which filled containers are conveyed in single file and in an upright orientation toward a downstream end of the conveyor. At the downstream end of the conveyor, the containers encounter a starwheel and a metering and transfer belt. Together, these elements space the containers out to correspond to the pitch of the packaging machine and move them laterally into corresponding cradle lugs of a transfer flight. Each cradle lug is shaped to receive and cradle a container as it moves progressively along the transfer flight. Further, the cradle lugs are pivotally connected to the transfer flight chains so that each cradle lug can be pivoted or articulated downwardly approximately ninety degrees. This reorients the containers cradled in the cradle lugs from an upright or vertical orientation to a prone or side orientation without the need to contact and potentially damage the containers themselves. A static rail or a cam and cam follower arrangement can be used to tilt over the cradle lugs gradually and gently to protect the containers cradled therein. Once the cradle lugs and containers are oriented on their sides, the pusher arms of a laterally adjacent inserter are progressively extended to push the containers into waiting open cartons, which also are oriented on their sides, moving synchronously along an oppositely adjacent carton flight.

Thus, a system and method is provided for manipulating large heavy containers as they move through a high speed packaging machine and transferring the containers into cartons in such a way that the containers are not damaged, are held securely in position during the loading process, and do not tend to fall or tip over in the event of a sudden machine stoppage. These and other features and advantages of the system and method disclosed herein will become more apparent upon review of the detailed description set forth below taken in conjunction with the accompanying drawing figures, which are briefly described as follows.

DETAILED DESCRIPTION

Figure 1:
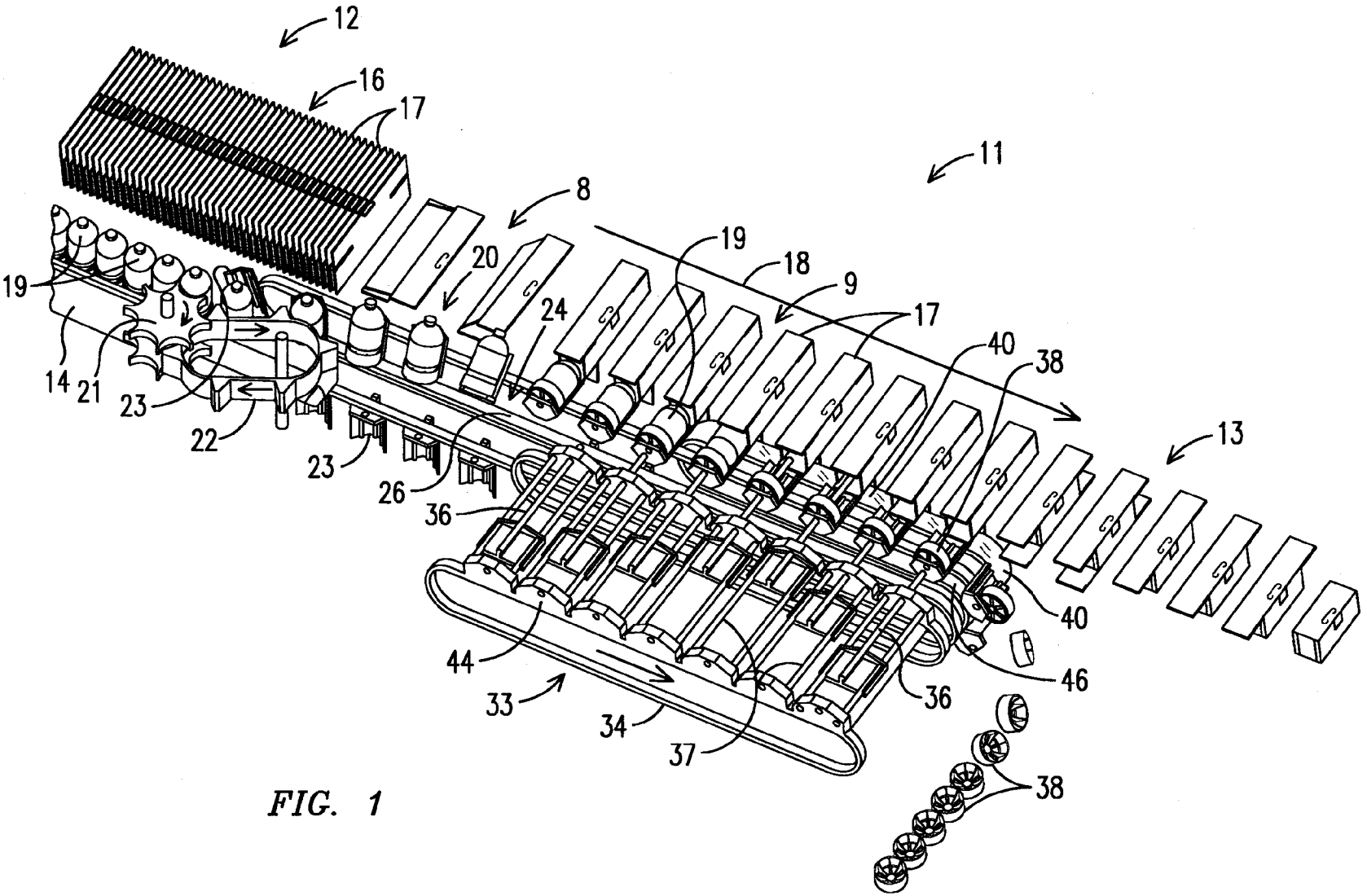
FIG. 1 is a top perspective view of a high speed container packaging machine that embodies principles of the invention in one preferred form.
Figure 10A:
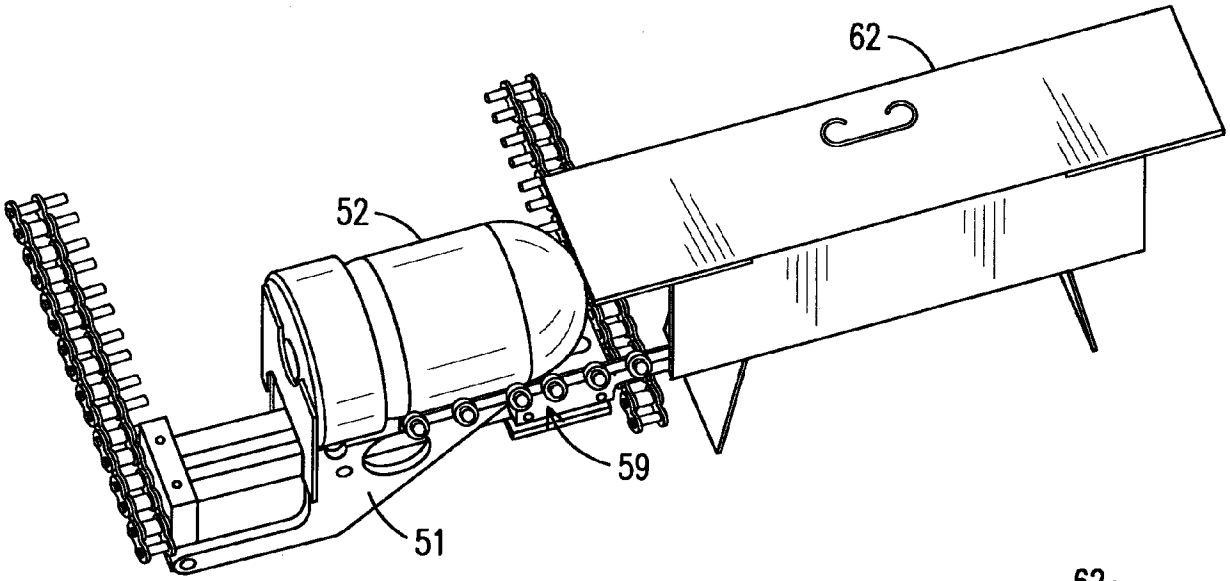
FIG. 10*a*-10*b* are enlarged perspective views showing the cradle lug and its container tipped over and being inserted into an adjacent synchronous carton.
Figure 10B:
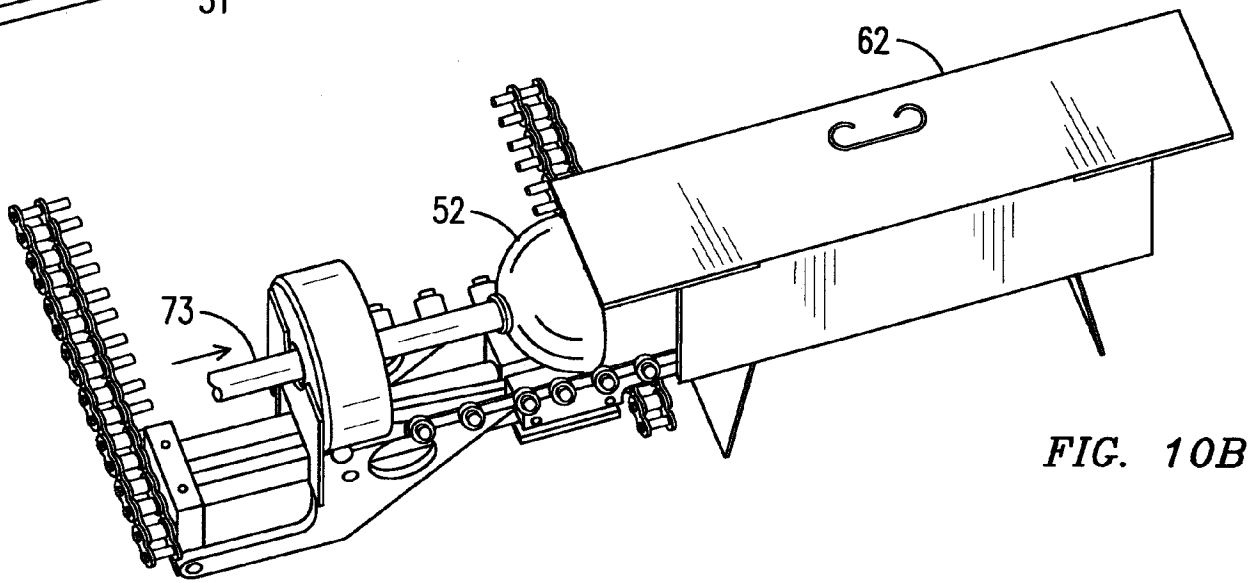
Figure 11:
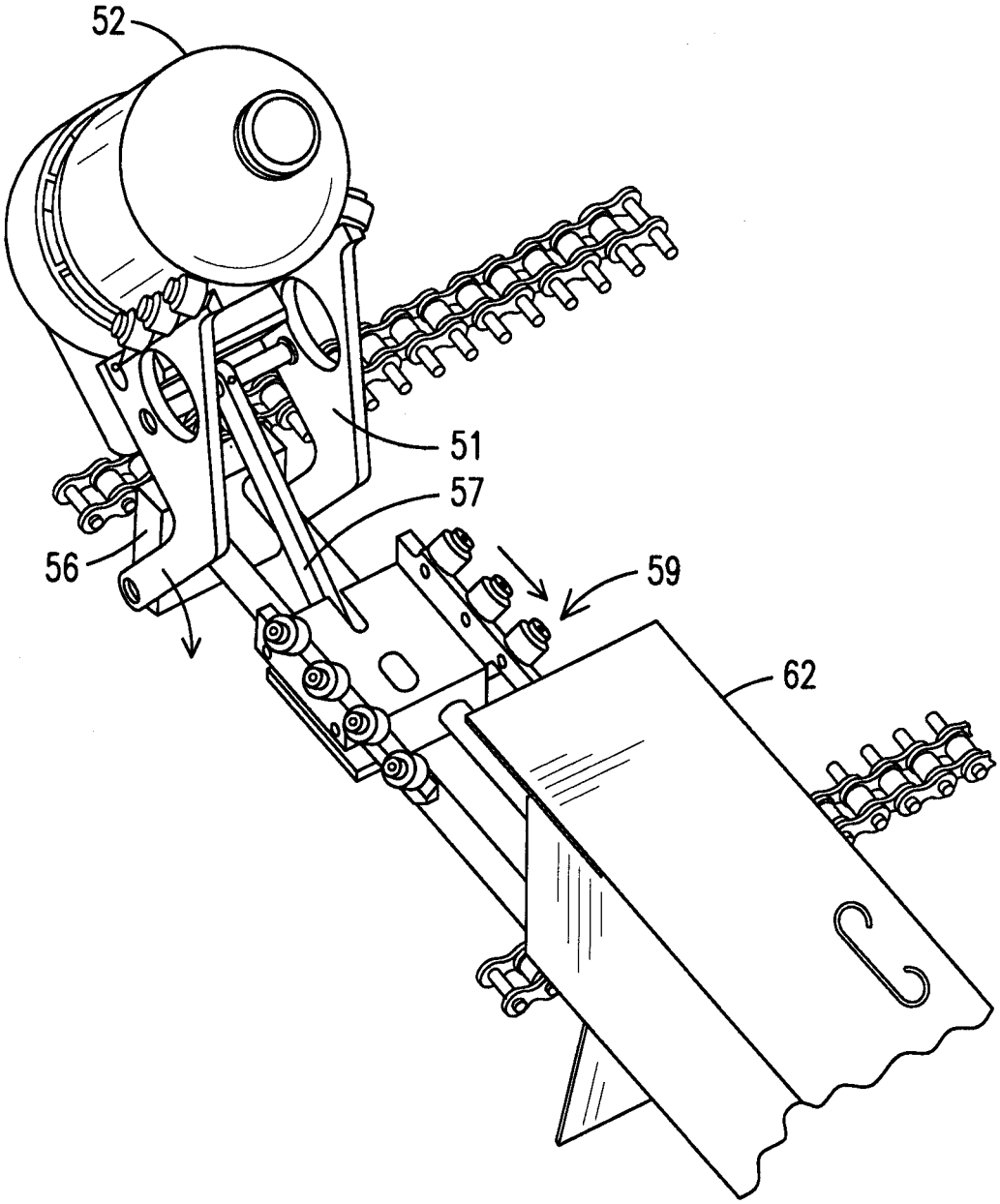
FIG. 11 is a perspective view of a cradle lug and container illustrating better the pivoting attachment of the cradle lug and the cam shaft that progressively tips the cradle lug to horizontal under the influence of an underlying cam track (not shown).

Referring now in more detail to the drawing figures, in which like reference numerals indicate like parts throughout the several views, FIGS. 1-8 illustrate a high speed packaging machine having a large container loading system that embodies principles of the invention in one preferred form. FIGS. 9-11 illustrate an alternate embodiment. Referring to FIG. 1, the packaging machine 11 has an upstream end 12 and a downstream end 13 and moves continuously in a downstream direction 18. An infeed conveyor 14 arranges large containers 19 such as large soft drink containers or mini-keg beer containers in single file and conveys them in the downstream direction by means of an underlying conveyor belt. A carton magazine 16 at the upstream end of the machine queues a plurality of cartons 17 in un-erected flattened configurations and positions them for delivery to a moving carton flight 9. As the cartons are delivered to the carton flight 9, they are erected in a known manner into an open configuration ready to receive containers, as indicated at 8. On the carton flight, the open cartons are spaced by cradle lugs to corresponding to the pitch of the packaging machine and conveyed in the downstream direction 18 oriented horizontally with one or more open ends.

A transfer flight 24 is disposed adjacent the carton flight and moves synchronously therewith in the downstream direction. The transfer flight carries an array of cradle lugs 23, each of which is aligned with and moves in synchronization with a corresponding carton on the carton flight 9. Thus, the spacing of the cradle lugs also corresponds to the pitch of the packaging machine. As perhaps best illustrated in FIG. 3, the cradle lugs 23 are pivotally attached by means of a pivot 27 to a chain of the transfer flight. In this way, the cradle lugs can articulate from an upright substantially vertical orientation as illustrated in the lower portion of FIG. 3 through approximately 90 degrees to a substantially horizontal or sideways orientation as illustrated in the upper portion of FIG. 3.

Referring again to FIG. 1, as the containers 19 reach the downstream end of the infeed conveyor, they encounter a starwheel 21, which delivers the containers one at a time to a metering and transfer belt or chain 22 located adjacent the upstream end of the transfer flight. Together, the starwheel and transfer belt space or meter the containers 19 to correspond to the pitch of the machine and the metering and transfer belt 22 transfers each container into a waiting upright cradle lug 23 of the transfer flight 24. In some instances, such as where the containers have rounded bottoms, the containers may be supported by ancillary pucks 38, which move with the containers into the cradle lugs. In other cases, such as where the containers have flat or supportive bottoms, pucks may not be needed to support the containers. If pucks are used, they preferably are provided with features that secure them to mating features on the bottom portions of the cradle lugs, as described in more detail below.

After having received a container 19 at the transfer belt, each cradle lug is progressively pivoted downwardly in a tipping or reorientation region 20 to reorient the cradle lug and consequently the container therein to a substantially horizontal sideways orientation. The pivoting of the cradle lugs can be accomplished in a variety of known ways such as, for example, with a static rail or using a cam and cam follower arrangement. Since such mechanisms are known, they are not illustrated in detail in these figures. In any event, the cradle lugs and their containers are pivoted and reoriented in a gradual and gentle manner and without machine elements other than the cradles contacting the containers themselves. This protects the containers and their contents from potential damage. When each cradle lug and its container are reoriented to a horizontal orientation, the container is transversely aligned with the open end of a corresponding horizontally oriented carton on the carton flight as shown in FIG. 1.

As the now horizontal containers 19 move in aligned synchronization with respective cartons, they encounter a loading or insertion region of the packaging machine. In this region, an inserter 33 is disposed adjacent to the transfer flight on the opposite side from the carton flight. The inserter generally comprises endless chains 34 that carry transversely oriented guide rails 37 attached to blocks 44. The chains and thus the guide rails are moved in the downstream direction 18 at the same rate as the containers and cartons. Push rods 36 are slidably mounted to the guide rails and are slidable toward and away from cartons on the oppositely adjacent carton flight. Further, the push rods are spaced to correspond to the pitch of the packaging machine so that each push rod is transversely aligned with a corresponding cradle lug and container, transversely aligned with a corresponding carton on the opposite side of the transfer flight, and moves synchronously with both.

As the cartons, containers, and push rods move in the downstream direction, the push rods 36 are progressively extended by a known cam and cam follower arrangement (not shown). This causes the end of each push rod 36 to extend through a hole 35 (FIG. 4) in the base of the adjacent cradle lug and through a hole 42 in the puck, if a puck is present, to engage the bottom of the container 19 carried by the cradle lug. Continued extension of the push rod pushes the container progressively out of its cradle lug and into the open end of an adjacent carton 17 on the carton flight 9. In this embodiment, a support conveyor 40 is disposed between the transfer flight and the carton flight. The support conveyor moves in synchronization with the transfer and carton flights and preferably is provided with spaced lugs (not visible) aligned with the containers on the transfer flight. The support conveyor supports each container 19 as it is urged by a push rod from the cradle lug 23 and toward an open carton, and the lugs of the support conveyor constrain the container and keep it properly oriented as it slides across the support conveyor. The container 19 is thus progressively urged out of its cradle lug, across the support conveyor, and inserted into the carton by the extending push rod 36. The loaded cartons then move to a closing station of the packaging machine, where the open end or ends of the containers are closed and sealed in a known manner to complete the packaging operation.

When insertion of a container into a carton is complete, the push rod is moved back to its retracted position by an appropriate cam and cam follower arrangement (not shown) or other appropriate mechanism. Each push rod is then carried around the downstream end of the inserter and back along the lower flight thereof to the upstream end of the inserter in preparation for the next cycle. A rotating puck ejector starwheel is disposed at the downstream end of the inserter and includes arms 46 that extend through a slot 31 (FIG. 4) adjacent the base of each cradle as the cradle lug rounds the downstream end of the inserter. Empty pucks 38 are thus ejected by the puck ejector starwheel from the cradle lugs in cases where pucks are used. The pucks can then be carried by a conveyor (not shown) or otherwise to a location where they can be reused in the packaging process.

Figure 2:
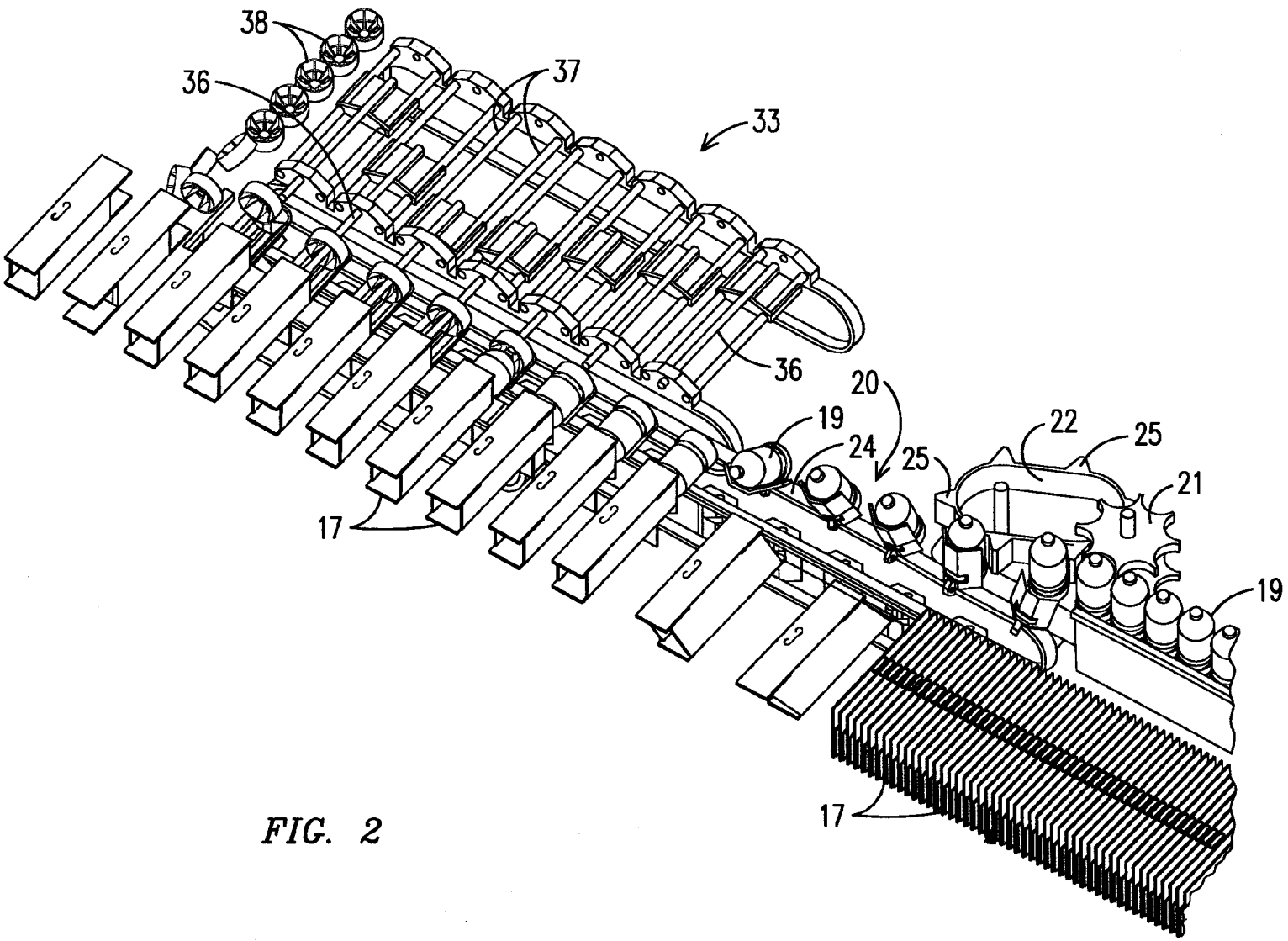
FIG. 2 is a perspective view of a portion of the packaging machine shown in FIG. 1 illustrating the metering, reorientation, and packaging of large containers according to an aspect of the invention.
Figure 3:
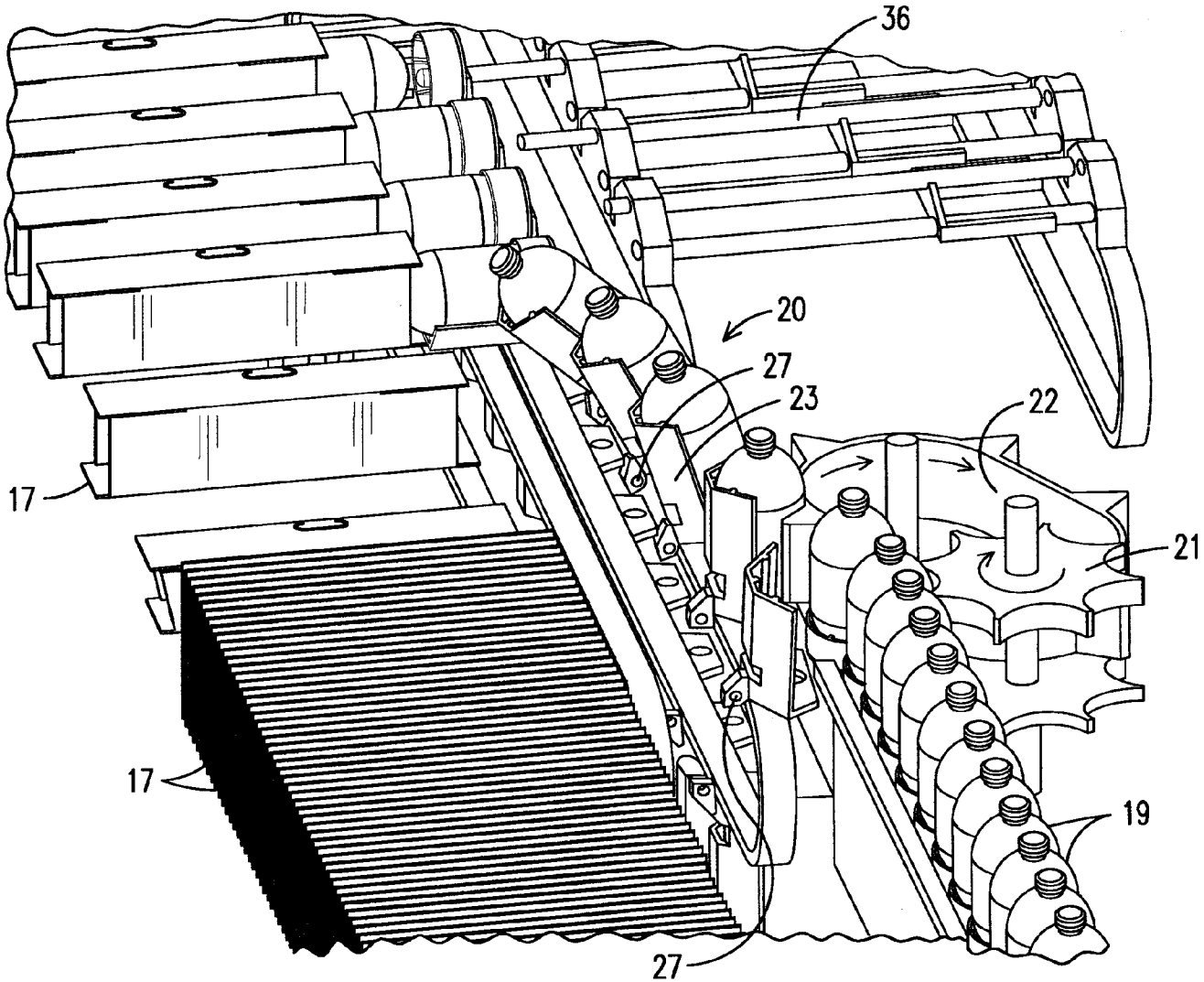
FIG. 3 is a close-up perspective view illustrating the cradling of containers in cradle lugs and the tilting of the cradle lugs to reorient the containers to be moved into waiting cartons.

FIGS. 2 and 3 illustrate the just described packaging machine and method from different perspectives, and thus do not require extensive separate discussions. Generally, however, FIG. 2 illustrates perhaps better the transfer of containers 19 from the infeed conveyor into corresponding cradle lugs of the transfer conveyor by the starwheel 21 and transfer and metering belt 22. The transfer and metering belt 22 carries spaced lugs 25 and is angled and driven so that each lug moves a corresponding container 19 from the infeed conveyor into an open cradle lug on the transfer flight as shown. FIG. 2 also illustrates perhaps more clearly the pivoting of the cradle lugs and their containers from their upright orientations to their horizontal orientations within the reorientation region 20 of the packaging machine. Also, the push rods 36 can be seen extending through the hole in the base of each cradle lug and through the hole in the corresponding puck to push the containers 19 across the support conveyor 40 and into waiting cartons 17.

FIG. 3 is an enlarged perspective of the reorientation region of the packaging machine showing the gradual and gentle reorientation of the cradle lugs 23 and their containers 19. While not explicitly shown in the figures for purposes of clarity, the pivot 27 of each cradle lug is pivotally attached to a carrier block that, in turn, is secured to a chain of the transfer flight. Also not shown in FIG. 3, as mentioned above, is the arrangement for progressively pivoting the cradle lugs. It will be understood by those skilled in the art, however, that this arrangement may be a static rail, a cam and cam follower arrangement, or any other arrangement known in the packaging industry for progressively moving components of a packaging machine. Regardless of the arrangement, the cradle lugs 23 and their containers are pivoted gradually and gently to prevent rapid acceleration and resulting damage to the containers and their contents.

Figure 4:
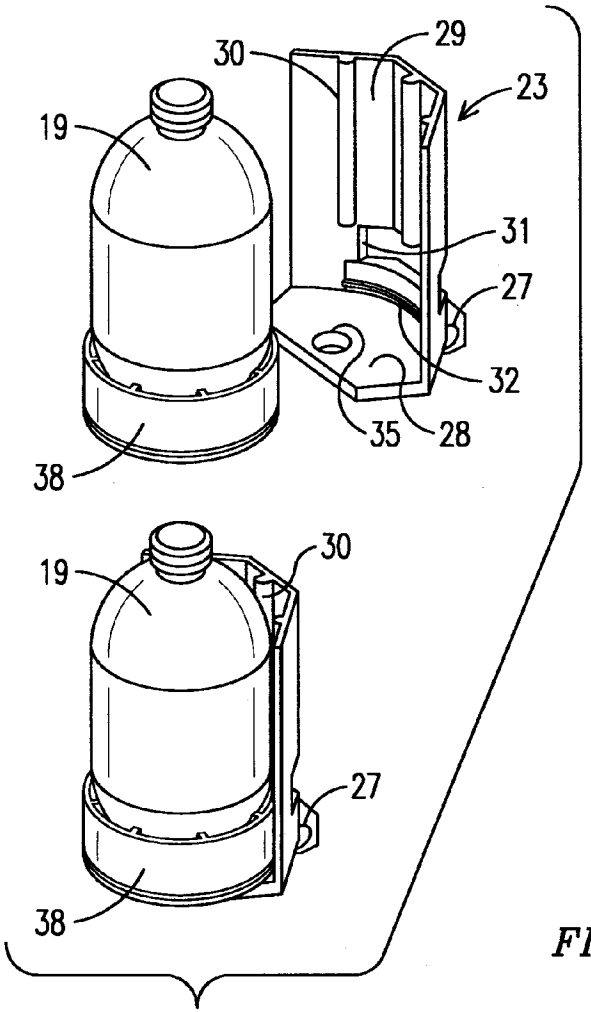
FIG. 4 is a perspective illustration showing one embodiment of a cradle lug and the fitting of a large container therein according to an aspect of the invention.

FIG. 4 illustrates in more detail one exemplary embodiment of the cradle lug of the packaging machine. In the illustrated embodiment, the cradle lug 23 has a base 28 from which a cradle 29 upwardly extends. The cradle 29 is formed with rails 30 that extend at least partially along its length to engage containers 19 and reduce friction between the cradle and the containers as the containers are pushed out of the cradles and into waiting cartons. Rollers or other features may be substituted for the illustrated rails with equivalent or perhaps improved results as described in more detail below with respect to an alternate embodiment. The base 28 is formed with a hole 35 through which a push rod can extend during the transfer of containers from the cradle lug. A slot 31 is formed in the cradle 29 adjacent the base 28 to accommodate the arms 46 of the puck ejection starwheel described above and a rib 32 may be formed around the bottom of the cradle to help hold a puck in place within the cradle. The pivot 27 is illustrated on the bottom back side of the cradle 29 to accommodate articulated pivoting movement of the cradle lug. It should be understood that the pivot may be disposed at other positions on the cradle lug such as, for instance, intermediate the ends of the cradle to obtain better balance during reorientation. However, this introduces additional challenges because, among other things, the level of the cradle when in its horizontal orientation will be higher and this must be compensated. Nevertheless, a pivot located other than at the bottom of the cradle lug is within the scope of the invention.

Figure 5:
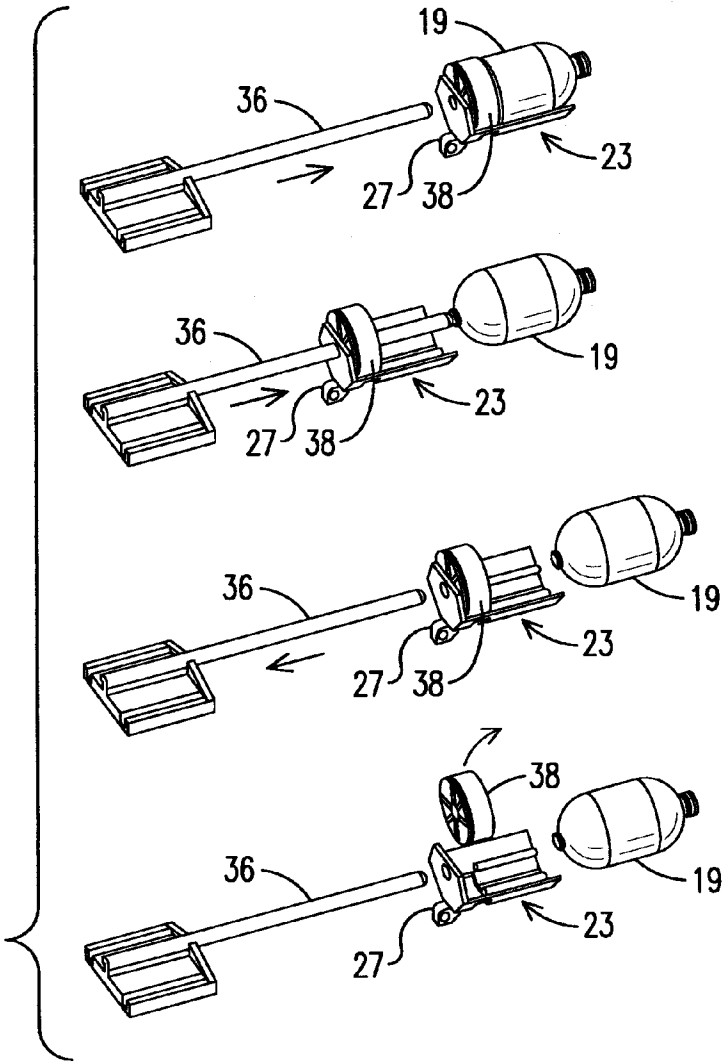
FIG. 5 is a perspective sequential image illustrating the movement of a large container out of its cradle lug and into a container with a pusher arm and the subsequent ejection of the puck that held the container.

The sequence of FIG. 5 illustrates more clearly the process of pushing a container 19 out of its cradle 23 and into an open carton (not shown in FIG. 5). For clarity, the support conveyor 40 and other components are not shown in FIG. 5. In the upper image of FIG. 5, the push rod 36 begins to extend toward the now horizontally oriented cradle lug 23 and container 19, which, in this illustration, has a rounded bottom and is supported by a puck 38. In the upper mid image, the push rod 36 has extended through the hole in the base of the cradle lug, through the central hole in the puck, and has engaged and pushed the container 19 out of the cradle, across the support conveyor (not shown), and into its carton. In the lower mid image, the push rod has been retracted by its cam arrangement out of the cradle lug and the transfer of the container 19 into its carton is complete. Finally, the lower image of FIG. 5 illustrates the ejection of the puck from the cradle, which can be accomplished by the ejector starwheel (not shown) so that it can be re-used in a subsequent packaging operation.

Figure 6:
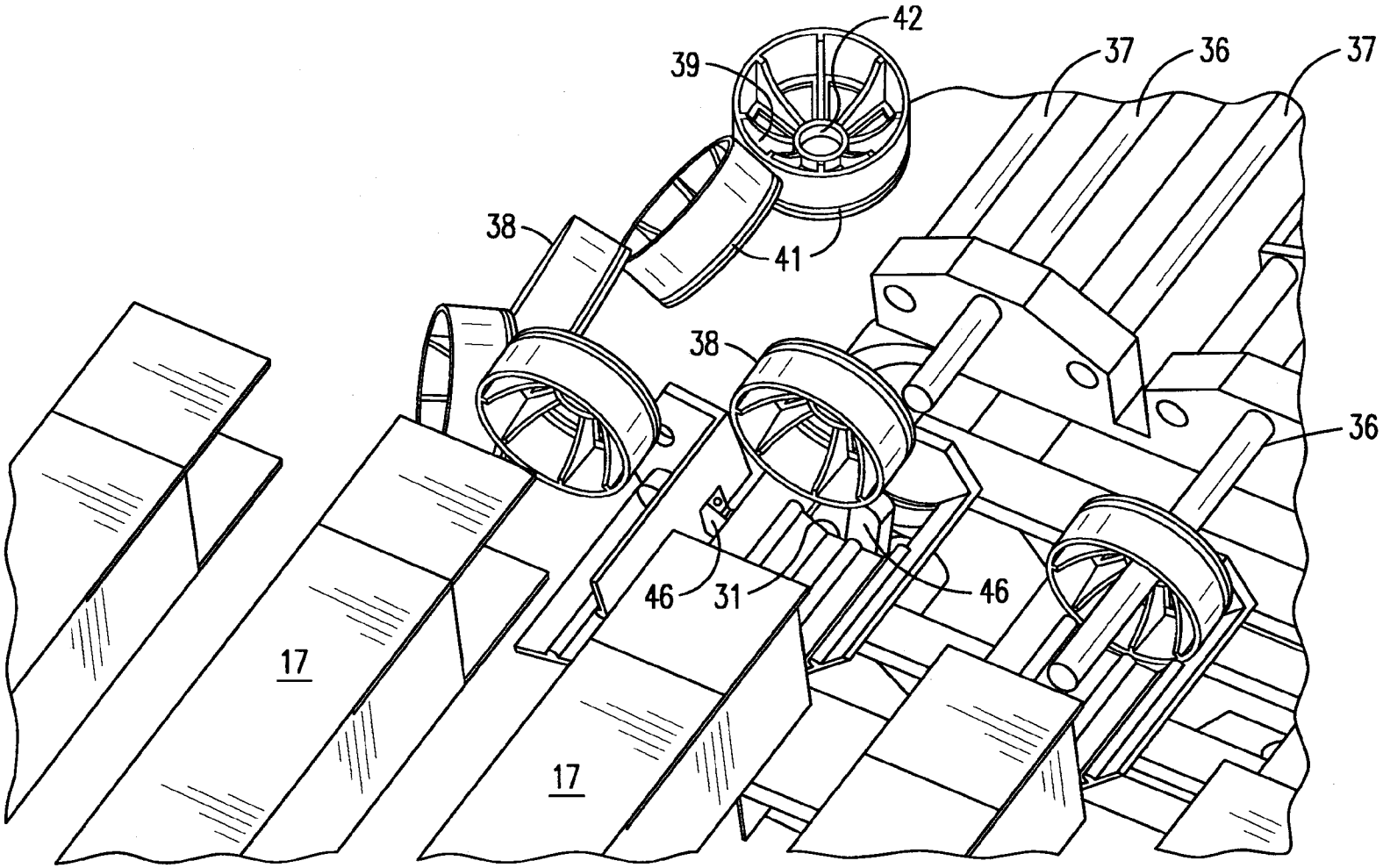
FIG. 6 is an enlarged perspective view of the downstream end of the transfer flight illustrating ejection of empty pucks from cradle lugs after the corresponding containers have been loaded into cartons.

FIG. 6 illustrates more clearly the ejection of pucks from their cradle lugs at the downstream end of the transfer flight of the packaging machine. A rotating starwheel is disposed beneath the transfer flight at its downstream end and the starwheel has arms 46. As the cradle lugs begin to move around the downstream end of the transfer flight, the arms 46 of the ejector starwheel project into each cradle lug through the slot 31 formed therein. This dislodges the puck from the cradle lug and ejects it into a collection bin or other collection and/or conveyor device so that the pucks can be reused in a subsequent packaging operation.

As seen in FIG. 1, when the cradle lugs move around to the bottom of the transfer flight, they swing back to their vertical orientation under the influence of their own weight. In this way, they are properly oriented vertically when they move back to the top of the transfer flight for their next cycle. Alternatively, rails, cams, or combinations thereof may be used to reorient the cradle lugs and hold them in their upright orientations until they are pivoted to horizontal orientations in the reorientation region 20 during their next cycle.

Figure 7A:
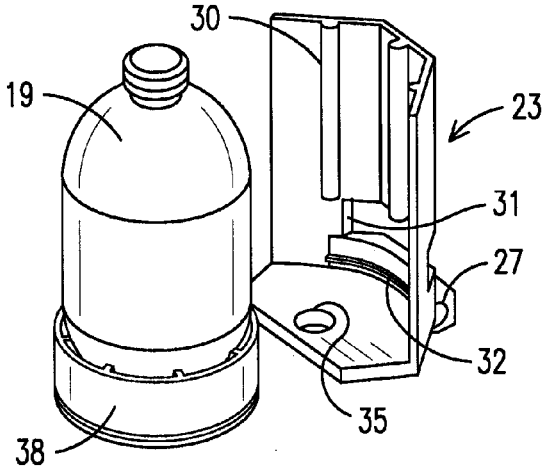
FIGS. 7*a*-7*d* are an array of perspective and cross-sectional figures illustrating a preferred configuration of the cradle lug, the fitting of the container and puck therein, the pushing of the container out of its cradle lug, and the subsequent ejection of the puck.
Figure 7B:
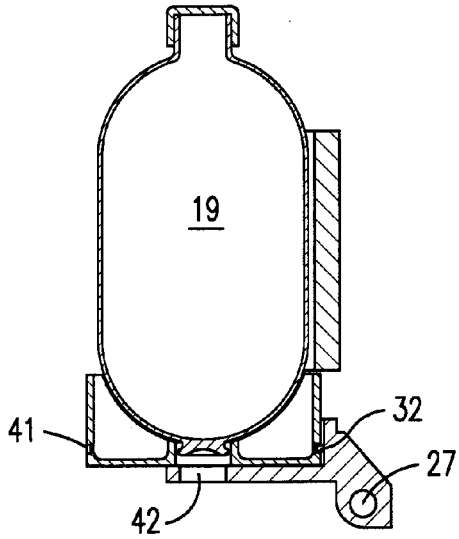
Figure 7D:
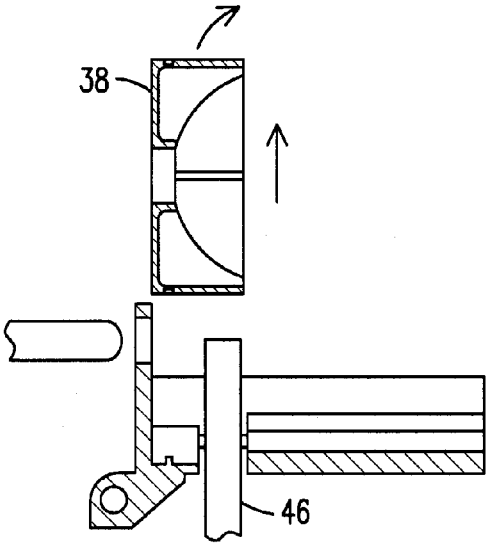
Figure 7C:
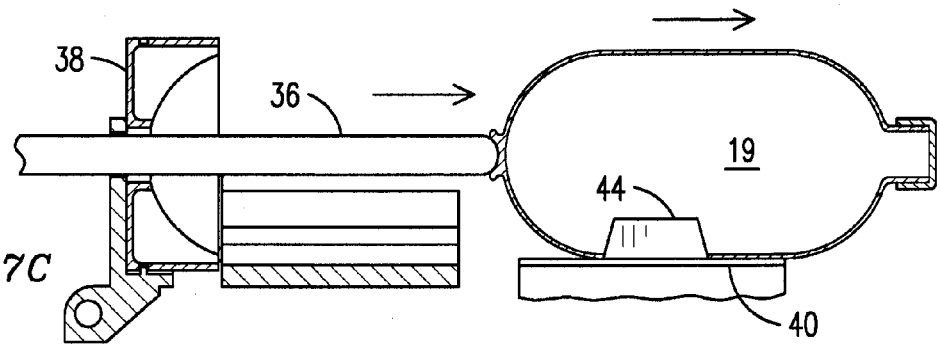

FIGS. 7*a*-7*d* illustrate some of the features discussed above perhaps more clearly. FIG. 7*a* shows a container 19 supported by a puck 38 and a cradle lug 23, as described. FIG. 7*b* is a cross section of the container 19 and its supporting puck disposed in the cradle lug. It can be seen here that, when the container and puck move into the cradle lug, the puck is releasably held in place by the rib 32 of the cradle lug extending into the groove 41 in the puck and by the top of the puck bearing against the top of the groove 31 in the cradle lug. While this is an illustrated embodiment, it will be understood that this groove and rib arrangement is not a requirement of the invention and that other or no mechanism for holding the puck and container in place in the cradle lug might be used by those of skill in the art. FIG. 7*c* shows in cross section the push rod 36 extending through the hole 35 in the base of the cradle lug and through the hole 42 in the puck to push the container 19 out of the cradle lug and into a waiting carton. The support conveyor 40 and its spaced lugs 44 support and constrain the container as it moves between the support cradle and the carton. Finally, FIG. 7*d* illustrates an arm 46 of the ejector starwheel projecting through the slot 31 of the cradle lug to eject the puck from the cradle lug at the downstream end of the transfer flight. While an ejector starwheel is illustrated and preferred, it will be understood that other arrangements for urging the puck out of the cradle lug might be substituted including, for example, a simple disc or a static guide engaging the puck through the back of the carrier.

One embodiment of the pivoting mechanism of the cradle lugs is described generally above. An alternate embodiment is shown in FIGS. 8 through 11. It will be understood that while one cradle lug is represented in the figures, there are in fact several mounted to the flight chain side-by-side along the flight. Referring first to FIGS. 8*a*-8*h*, chain flights 67 and 68 carry guide rods 72 on which a transfer block 59 is slidably mounted. The transfer block 59 has an array of rollers 61 arranged in tracks for supporting a container 52 as it moves between a the cradle lug and an open carton, and allowing it to move easily across the transfer block into a carton 62. As discussed in more detail below, the transfer block and its rollers replace the support conveyor 40 of the previously discussed embodiment. Thus, the support conveyor can be eliminated to simplify and reduce the cost of a packaging machine.

A pivot block 56 is mounted to the chain flight 68 and supports back ends of the guide rods 72. A cradle lug 51 is configured to receive a container 52 and includes an array of spaced rollers 50 aligned in tracks against which the container rests and along which the container can slide during insertion into a carton. A pivot leg 54 projects from the cradle lug 51 and is pivotally attached to the pivot block 56 at a location below the guide rods 72. Thus, the cradle lug can pivot about its pivotal connection to the pivot block to move the cradle lug between the upright or vertical orientation shown in FIGS. 8*a* and 8*e* and the sideways or horizontal orientation shown in FIGS. 8*c* and 8*g*.

Figure 8A:
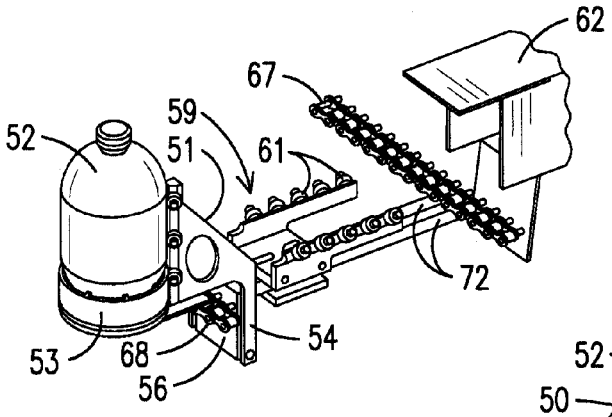
FIGS. 8*a*-8*h* depict a sequential illustration of an alternate cradle lug and transfer block and an alternate system for tipping cradle lugs and their contents from vertical to horizontal orientations.
Figure 8B:
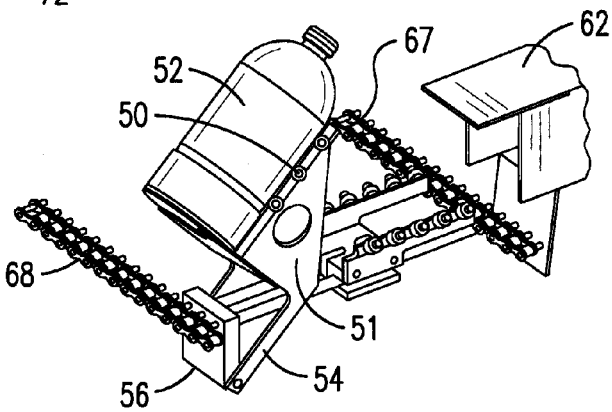
Figure 8C:
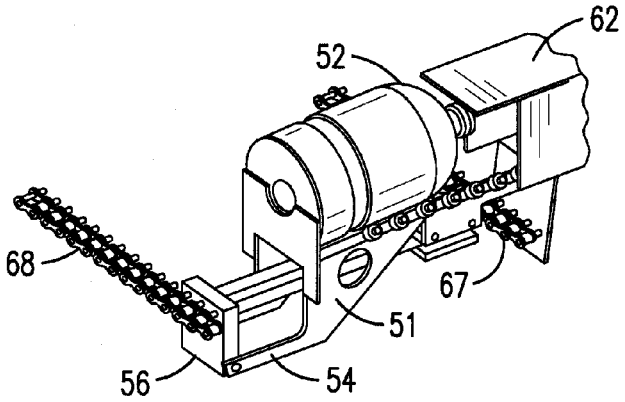
Figure 8D:
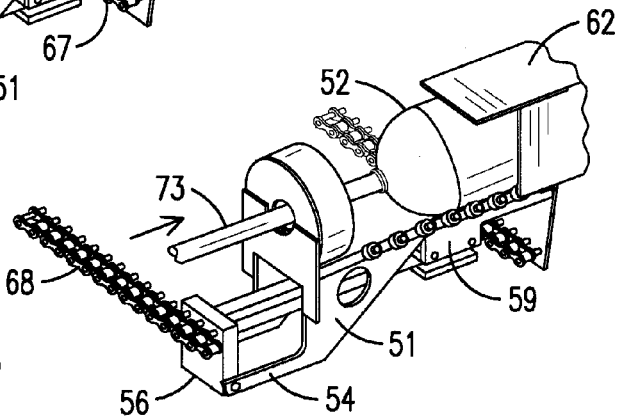
Figure 8E:
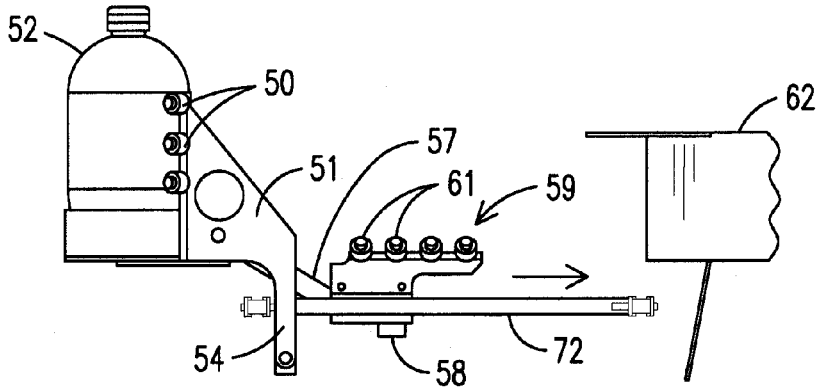
Figure 8F:
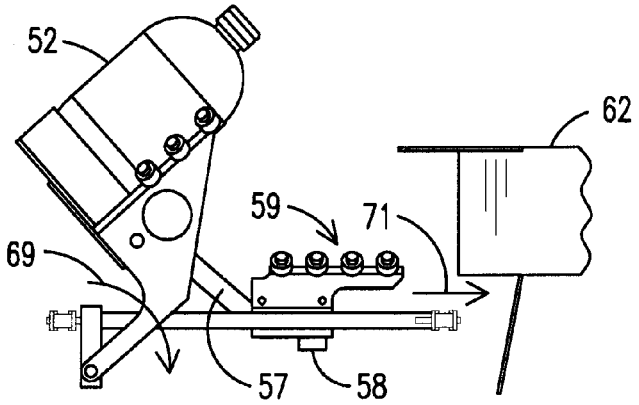
Figure 8G:
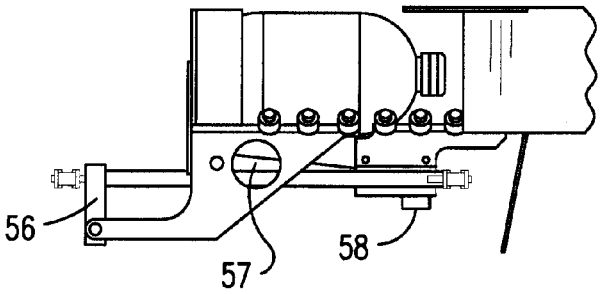
Figure 8H:
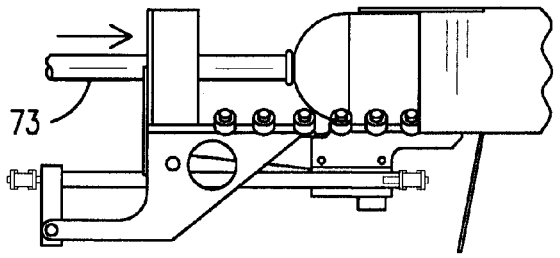

A cam arm 57 is pivotally mounted at its upper end to the cradle lug and is pivotally mounted at its lower end to the transfer block. A cam follower 58 is secured to the bottom of the transfer block and projects downwardly therefrom where it rides in a cam track (not illustrated) below the transfer block. Thus, the transfer block 59 and the cradle lug 51 are coupled together by the cam arm 57 such that movement of the transfer block 59 to the right as illustrated by arrow 71 in FIG. 8*f* causes the cradle lug 51 and a container cradled therein to tilt from a vertical orientation to a horizontal orientation, as best illustrated in the sequence 8*e, f, g*, and *h*. The cam track within which the cam follower 58 rides is configured such that as the cradle lug and transfer block move in the downstream direction adjacent synchronously moving cartons, the transfer block is progressively moved to the right until its end moves partially into or directly adjacent the open mouth of the carton. Simultaneously, the cradle lug and the container cradled therein progressively pivot downwardly as indicated by arrow 69 toward a horizontal orientation. When the cradle lug reaches its horizontal orientation, the rollers of the cradle lug and the transfer block are aligned with each other forming low friction roller tracks that support a container as it is transferred from its cradle lug, across the rollers of the transfer block, and into the carton as illustrated in FIGS. 8*d* and 8*h*. The rollers reduce the shock, friction, and impact on the container and its contents, which can otherwise be present in a high speed packaging machine. Further, the extension of the transfer block into or at least directly adjacent the open mouth of the carton ensures against collisions between the container and the carton so that the container moves easily and reliably into a waiting carton. At the same time, the container is constrained by the roller tracks so that it does not become skewed as it moves toward the carton. Perhaps most salient, however, is that the roller block and its roller tracks completely replaces the support conveyor and lugs of the previously described embodiment thereby reducing the complexity and cost of a packaging machine.

Figure 9A:
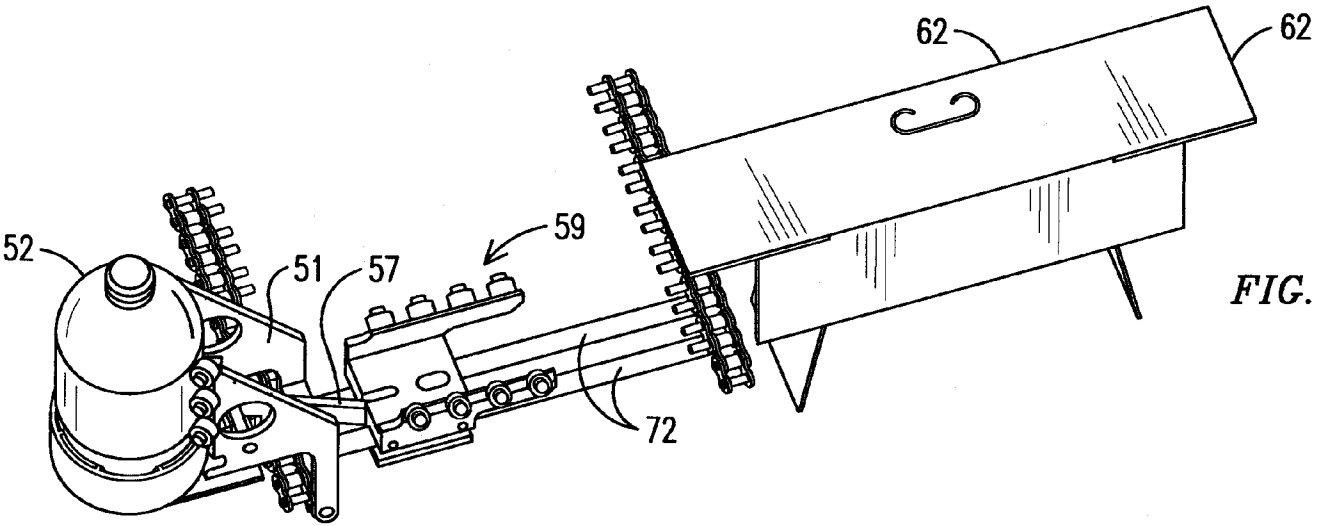
FIGS. 9*a*-9*b* are enlarged perspectives showing a cradle lug beginning to be tipped over to a horizontal orientation.
Figure 9B:
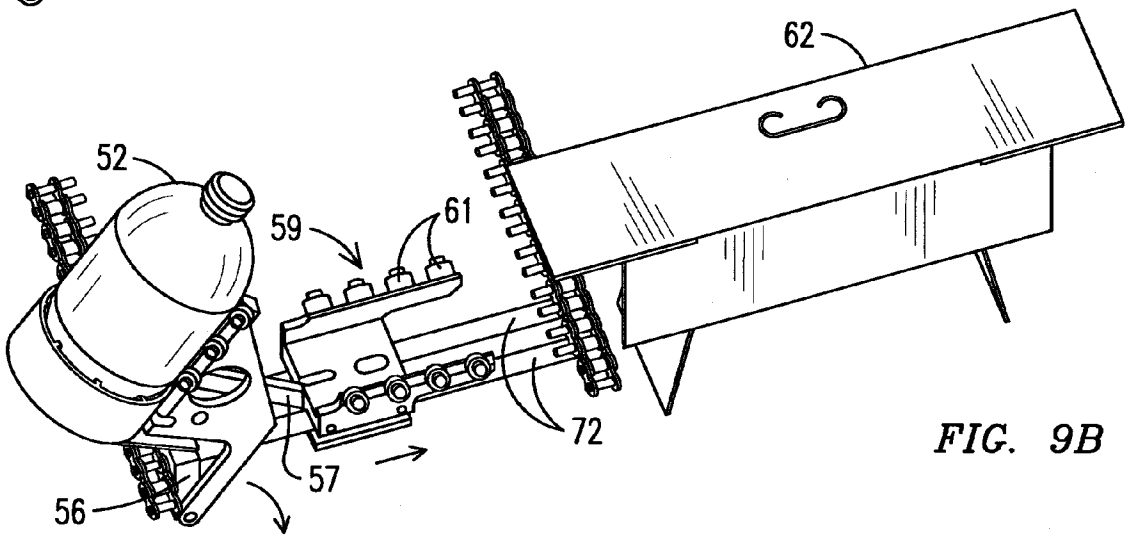

FIGS. 9*a* and 9*b* illustrate the beginning of the sequence just described with respect to FIGS. 8*a*-8*h*. In FIG. 9*a*, the cradle lug 51 is vertical and the transfer block 59 is at its leftmost position. In FIG. 9*b*, seen further downstream, the cam follower on the bottom of the transfer block 59 has begun to move to the right toward the carton 62 under the influence of the cam track in which it rides. Simultaneously, the cam arm 57 begins to pull and pivot the cradle lug 51 downwardly as indicated by the arrows toward a horizontal orientation. The sequence continues in FIGS. 10*a* and 10*b*. In FIG. 10*a*, yet further downstream, the transfer block 59 has been moved completely to the right by its cam follower and the rightmost end of the transfer block has been extended partially into or at least directly adjacent to the open end of the carton 62. This helps align the carton and hold it in the proper position for receiving a container. At the same time, the rollers along the transfer block align with the rollers of the cradle lug to form low friction roller tracks into the open carton. In FIG. 10*b*, still further downstream, a push rod 73 has been extended through the bottom of the cradle lug and is seen pushing the container 52 across the roller tracks and into the open carton on the carton track. It can be seen here that the roller tracks of the transfer block support the container as it moves between the cradle lug and the carton, eliminating the need for the auxiliary support conveyor of the previously described embodiment. Once the container is inserted, the cam follower 58 and cam track can cause the transfer block to slide back to the left and cradle lug to pivot back up to a vertical orientation to position them for receiving another container in a succeeding cycle.

FIG. 11 shows the assembly in the same configuration as the lower view in FIG. 9 but from a different perspective that illustrates perhaps more clearly the cam arm 57 connecting the transfer block and the cradle lug and other components as described. The transfer block 59 is seen being moved toward the open end of a carton 62 by the cam follower arrangement on the bottom of the pivot block. The moving transfer block, in turn, pulls the cam arm 57, which pulls the cradle lug 51 attached to the other end of the cam arm 57. The cradle lug 51 thus begins to pivot downwardly about its pivotal connection to the pivot block 56 as indicated by the arcuate arrow in FIG. 11. Continued movement of the transfer block 59 toward and perhaps partially into the carton pivots the cradle lug completely down to a horizontal orientation, wherein its rollers align horizontally with the rollers of the transfer block 59 to form a pair roller tracks for support and transfer of the container into the open carton.

The invention has been described herein in terms of preferred embodiments, configurations, and methodologies considered by the inventor to represent the best mode or modes of carrying out the invention. It will be understood, however, that a wide array of modifications, additions, and deletions, both subtle and gross, might well be made to the illustrated embodiments by those of skill in the art without departing from the spirit and scope of the invention, which is defined only by the claims.

What is claimed is:

1. A packaging machine comprising:

a transfer flight having a reorientation region;

a plurality of cradle lugs arranged in spaced relationship along the transfer flight;

a conveyor assembly for moving the cradle lugs in a downstream direction along the transfer flight;

an articulating attachment between each cradle lug and the conveyor assembly, the articulating attachment facilitating movement of the cradle lug from a first orientation to a second orientation; and a control mechanism coupled to each cradle lug for progressively moving the cradle lugs from the first orientation to the second orientation as the cradle lugs are conveyed through the reorientation region of the transfer flight, wherein each cradle lug of the plurality of cradle lugs comprises a cradle extending from a base for at least partially supporting a container in the cradle lug as the cradle lug moves from the first orientation to the second orientation, and at least one puck is removably disposed in at least one cradle lug of the plurality of cradle lugs adjacent the respective base for engaging the container in the at least one cradle lug as the cradle lug moves from the first orientation to the second orientation.

2. The packaging machine as claimed in claim 1 and wherein each cradle lug is configured to cradle a container and to constrain the container as the cradle lug moves from the first orientation to the second orientation.

3. The packaging machine as claimed in claim 2 and further comprising rails formed in each cradle lug for reducing sliding friction between the cradle lug and a container cradled therein.

4. The packaging machine as claimed in claim 3, wherein the cradle has a back and two sides that are oblique with respect to the back, and the rails comprise at least one rail on each of the two sides.

5. The packaging machine as claimed in claim 1 and further comprising an opening in the base sized to allow a push rod to extend through the opening for pushing the container out of the cradle lug.

6. The packaging machine as claimed in claim 1 and further comprising an ejector slot formed in each cradle lug sized to receive an ejector for ejecting the puck from the cradle lug.

7. The packaging machine as claimed in claim 1 and wherein the conveyor assembly comprises an endless chain and wherein the cradle lugs are attached to the endless chain.

8. The packaging machine as claimed in claim 1 and wherein the articulating attachment is a pivot.

9. The packaging machine as claimed in claim 1 and wherein the control mechanism comprises a static rail.

10. The packaging machine as claimed in claim 1 and wherein the control mechanism comprises a cam and cam follower.

11. The packaging machine as claimed in claim 1, further comprising a push rod for pushing the container out of the cradle lug away from the base.

12. The packaging machine as claimed in claim 11, wherein the base comprises a first hole and the puck comprises a second hole, and the push rod extends at least partially through the first hole and the second hole to push the container.

13. The packaging machine as claimed in claim 11, wherein the cradle comprises a rib that at least partially retains the puck adjacent the base as the push rod pushes the container away from the base.

14. The packaging machine as claimed in claim 1, wherein the cradle comprises an ejector slot that is generally aligned with the puck proximate the base, and the ejector slot is for receiving an ejector arm configured to eject the puck from the cradle lug.

15. A packaging machine comprising:

a transfer flight having a reorientation region;

a plurality of cradle lugs arranged in spaced relationship along the transfer flight;

a conveyor assembly for moving the cradle lugs in a downstream direction along the transfer flight;

an articulating attachment between each cradle lug and the conveyor assembly, the articulating attachment facilitating movement of the cradle lug from a first orientation to a second orientation, wherein each cradle lug is configured to cradle a container and to constrain the container as the cradle lug moves from the first orientation to the second orientation;

a control mechanism coupled to each cradle lug for progressively moving the cradle lugs from the first orientation to the second orientation as the cradle lugs are conveyed through the reorientation region of the transfer flight; and a first plurality of rollers on each of the cradle lugs positioned to support the container in the cradle lug and facilitate movement of the container out of the cradle lug when the cradle lug is in the second orientation.

16. The packaging machine as claimed in claim 15 and further comprising a transfer block associated with each cradle lug and having a second plurality of rollers, each transfer block being in a transfer position with the second plurality of rollers aligned with the first plurality of rollers on the cradle lug when the cradle lug is in the second orientation.

17. The packaging machine as claimed in claim 16 and wherein the transfer block is movable to the transfer position and further comprising a cam arm coupled at one end to the transfer block and at an opposite end to the cradle lug, the cam arm moving the cradle lug from the first orientation to the second orientation as the transfer block moves toward the transfer position.

18. The packaging machine as claimed in claim 17 and further comprising a cam track extending along the transfer flight at least in the reorientation region and a cam follower attached to each of the transfer blocks and riding in the cam track, the cam track being configured to move each of the transfer blocks into the transfer position as the transfer block and its associated cradle lug move in the downstream direction through the reorientation region.

19. A container conveyor and reorientation assembly for a packaging machine having a transfer flight and a carton flight moving synchronously in a downstream direction, the container conveyor and reorientation assembly comprising:

a cradle lug comprising a cradle extending from a base for at least partially supporting a container in the cradle lug;

a puck removably disposed in the cradle lug adjacent the base for engaging the container in the cradle lug;

an articulating mount securing the cradle lug to the transfer flight;

the articulating mount facilitating movement of the cradle lug between a substantially upright orientation and a substantially sideways orientation; and a control assembly for progressively moving the cradle lug from the substantially upright orientation to the substantially sideways orientation as the cradle lug moves with the transfer flight in the downstream orientation.

20. The container conveyor and reorientation assembly as claimed in claim 19 and further comprising a transfer block associated with the cradle lug and being in a transfer position between the cradle lug and the carton flight when the cradle lug is in its substantially sideways orientation.

21. The container conveyor and reorientation assembly as claimed in claim 19, further comprising a push rod for pushing the container out of the cradle lug away from the base.

22. The container conveyor and reorientation assembly as claimed in claim 21, wherein the base comprises a first hole and the puck comprises a second hole, and the push rod extends at least partially through the first hole and the second hole to push the container.

23. The container conveyor and reorientation assembly as claimed in claim 21, wherein the cradle comprises a rib that at least partially retains the puck adjacent the base as the push rod pushes the container away from the base.

24. The container conveyor and reorientation assembly as claimed in claim 19, wherein the cradle comprises an ejector slot that is generally aligned with the puck proximate the base, and the ejector slot is for receiving an ejector arm configured to eject the puck from the cradle lug.

25. The container conveyor and reorientation assembly as claimed in claim 19, wherein the cradle has a back and two sides that are oblique with respect to the back, and the cradle lug further comprises at least one rail on each of the two sides for reducing sliding friction between the cradle lug and a container cradled therein.

26. A container conveyor and reorientation assembly for a packaging machine having a transfer flight and a carton flight moving synchronously in a downstream direction, the container conveyor and reorientation assembly comprising:

a cradle lug;

an articulating mount securing the cradle lug to the transfer flight;

the articulating mount facilitating movement of the cradle lug between a substantially upright orientation and a substantially sideways orientation;

a control assembly for progressively moving the cradle lug from the substantially upright orientation to the substantially sideways orientation as the cradle lug moves with the transfer flight in the downstream orientation;

a transfer block associated with the cradle lug and being in a transfer position between the cradle lug and the carton flight when the cradle lug is in its substantially sideways orientation; and an array of rollers on the cradle lug and an array of rollers on the transfer block, the array of rollers on the transfer block being substantially aligned with the array of rollers on the cradle lug when the cradle lug is in its substantially sideways orientation.

27. A container conveyor and reorientation assembly for a packaging machine having a transfer flight and a carton flight moving synchronously in a downstream direction, the container conveyor and reorientation assembly comprising:

a cradle lug;

an articulating mount securing the cradle lug to the transfer flight;

the articulating mount facilitating movement of the cradle lug between a substantially upright orientation and a substantially sideways orientation;

a control assembly for progressively moving the cradle lug from the substantially upright orientation to the substantially sideways orientation as the cradle lug moves with the transfer flight in the downstream orientation;

a transfer block associated with the cradle lug and being in a transfer position between the cradle lug and the carton flight when the cradle lug is in its substantially sideways orientation, wherein the transfer block is progressively movable toward the transfer position; and a cam arm coupled at one end to the transfer block and at an opposite end to the cradle lug, the cam arm progressively moving the cradle lug to its sideways orientation as the transfer block is moved toward its transfer position.

28. The container conveyor and reorientation assembly as claimed in claim 27 and wherein the control assembly comprises a cam track and cam follower arrangement.

29. The container conveyor and reorientation assembly as claimed in claim 28 and wherein the cam track extends along the transfer flight and wherein the cam follower is attached to the transfer block and rides in the transfer flight, the cam track being configured to move the transfer block to its transfer position and, through the cam arm, the cradle lug to its sideways orientation.

* * * * *